US008262212B2

(12) United States Patent
Mitsuzawa

(10) Patent No.: US 8,262,212 B2
(45) Date of Patent: Sep. 11, 2012

(54) LIQUID DISCHARGING APPARATUS AND IMAGE FORMING METHOD

(75) Inventor: Toyohiko Mitsuzawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 279 days.

(21) Appl. No.: 12/643,765

(22) Filed: Dec. 21, 2009

(65) Prior Publication Data

US 2010/0165021 A1 Jul. 1, 2010

(30) Foreign Application Priority Data

Dec. 25, 2008 (JP) ..... 2008-330977

(51) Int. Cl.
*B41J 2/01* (2006.01)

(52) U.S. Cl. ..... 347/102

(58) Field of Classification Search ..... 347/9, 102; 430/320
See application file for complete search history.

(56) References Cited

U.S. PATENT DOCUMENTS

| | | | | |
|---|---|---|---|---|
| 6,561,640 | B1 * | 5/2003 | Young | 347/102 |
| 7,249,836 | B2 * | 7/2007 | Yokoyama | 347/102 |
| 7,607,773 | B2 * | 10/2009 | Nagashima | 347/102 |

FOREIGN PATENT DOCUMENTS

| | | | |
|---|---|---|---|
| JP | 2000-158793 | A | 6/2000 |
| JP | 2003-145725 | A | 5/2003 |
| JP | 2004-276584 | A | 10/2004 |
| JP | 2006-150632 | A | 6/2006 |
| JP | 2006-159684 | A | 6/2006 |

* cited by examiner

*Primary Examiner* — An Do
(74) *Attorney, Agent, or Firm* — Kilpatrick Townsend & Stockton LLP

(57) ABSTRACT

A liquid discharging apparatus includes: nozzles which discharge liquid which is cured by the irradiation of electromagnetic waves; an irradiation section which irradiates the electromagnetic waves to dots formed on a medium by the liquid discharged from the nozzles; and a controller which controls the discharging of the liquid from the nozzles and changes the irradiation amount of the electromagnetic waves that the irradiation section irradiates, according to methods of forming the dots.

7 Claims, 13 Drawing Sheets

PAPER BASE

| CURRENT VALUE [A] | IMAGE QUALITY | | | |
|---|---|---|---|---|
| | BLEEDING | COHESION | FILLING | GLOSS |
| 0.2 | △ | × | ○ | △~○ |
| 0.3 | △ | △ | ○ | △~○ |
| 0.4 | △ | △ | ○ | △~○ |
| 0.5 | ○ | ○ | ○ | △~○ |
| 0.6 | ○ | ○ | ○ | △~○ |

FIG. 10

| ITEMS | DECISION | DECISION CONTENTS | DEFECTS IN IMAGE |
|---|---|---|---|
| BLEEDING | ○ | ONLY A SINGLE COLOR, OR THERE IS NO OOZING BETWEEN DIFFERENT COLORS. | 1) OOZING OCCURS AT A COLOR BORDER IN A NATURAL IMAGE.<br>2) THE SHARPNESS OF THE EDGE OF AN IMAGE OR A LETTER IS INFERIOR. |
| | △ | ONLY A SINGLE COLOR, OR THERE IS SOMEWHAT OF OOZING BETWEEN DIFFERENT COLORS. HOWEVER, IT IS NOT VISUALLY FELT SO UNEASY. | |
| | × | ONLY A SINGLE COLOR, OR THERE IS OOZING BETWEEN DIFFERENT COLORS. | |
| COHESION | ○ | THERE IS NO IN-PLANE COHESION (PARTIAL BIAS OF INK) OF SINGLE COLOR/2 COLORS/3 COLORS. | 1) INK IN AN IMAGE PARTIALLY COHERES.<br>2) COLOR UNEVENNESS OCCURS.<br>3) IN UV INK, CONCAVITY/CONVEXITY IS VISIBLE ON A SURFACE. |
| | △ | THERE IS SOMEWHAT OF IN-PLANE COHESION (PARTIAL BIAS OF INK) OF ANY OF SINGLE COLOR/2 COLORS/3 COLORS. HOWEVER, IT IS NOT VISUALLY FELT SO UNEASY. | |
| | × | THERE IS IN-PLANE COHESION (PARTIAL BIAS OF INK) OF ANY OF SINGLE COLOR/2 COLORS/3 COLORS. | |
| FILLING | ○ | FILLING IN 100% SINGLE COLOR (SINGLE COLOR DUTY) HAS NO PROBLEM. | 1) GRAZE AT A SOLID PORTION (PORTION HAVING HIGH DUTY).<br>2) GRAZE OR STRIPE AT A DARK PORTION. |
| | △ | FILLING IN 100% SINGLE COLOR (SINGLE COLOR DUTY) IS SOMEWHAT BAD (THERE IS SOMEWHAT OF A STRIPE.) | |
| | × | FILLING IN 100% SINGLE COLOR (SINGLE COLOR DUTY) IS BAD. (A STRIPE IS CLEARLY FOUND.) | |
| GLOSS | ○ | GLOSS IN 100% SINGLE COLOR (SINGLE COLOR DUTY) HAS NO PROBLEM. | 1) THERE IS NO GLOSS FEELING OF AN IMAGE SURFACE. |
| | △ | GLOSS IN 100% SINGLE COLOR (SINGLE COLOR DUTY) IS SOMEWHAT INFERIOR. | |
| | × | GLOSS IN 100% SINGLE COLOR (SINGLE COLOR DUTY) IS INFERIOR. | |

| | LED INPUT CURRENT [A] | IRRADIATION ENERGY [mW/cm$^2$] |
|---|---|---|
| 4 PASS | 0.5 | 1.0 |
| 2 PASS | 1.0 | 2.0 |

FIG. 14

FILM

| CURRENT VALUE [A] | IMAGE QUALITY | | | |
|---|---|---|---|---|
| | BLEEDING | COHESION | FILLING | GLOSS |
| 0.2 | × | × | ○ | ○ |
| 0.3 | △ | ○ | ○ | ○ |
| 0.4 | △ | ○ | △ | ○ |
| 0.5 | ○ | ○ | △ | △ |
| 0.6 | ○ | ○ | × | △ |

SYNTHETIC PAPER

| CURRENT VALUE [A] | IMAGE QUALITY | | | |
|---|---|---|---|---|
| | BLEEDING | COHESION | FILLING | GLOSS |
| 0.2 | × | × | ○ | ○ |
| 0.3 | × | △ | ○ | ○ |
| 0.4 | ○ | ○ | ○ | ○ |
| 0.5 | ○ | ○ | △ | △ |
| 0.6 | ○ | ○ | × | △ |

PAPER BASE

| CURRENT VALUE [A] | IMAGE QUALITY | | | |
|---|---|---|---|---|
| | BLEEDING | COHESION | FILLING | GLOSS |
| 0.2 | △ | × | ○ | △ ~ ○ |
| 0.3 | △ | △ | ○ | △ ~ ○ |
| 0.4 | △ | △ | ○ | △ ~ ○ |
| 0.5 | ○ | ○ | ○ | △ ~ ○ |
| 0.6 | ○ | ○ | ○ | △ ~ ○ |

FIG. 15

| | LED INPUT CURRENT VALUE [A] | IRRADIATION ENERGY [mW/cm$^2$] |
|---|---|---|
| FILM SYSTEM | 0.3 | 0.6 |
| SYNTHETIC PAPER | 0.4 | 0.8 |
| PAPER BASE | 0.5 | 1.0 |

FIG. 16

| | LED INPUT CURRENT [A] | |
|---|---|---|
| PRINTING MODE | 720×720 dpi 4 PASS | 720×720 dpi 2 PASS |
| FILM SYSTEM | 0.3 | 0.6 |
| SYNTHETIC PAPER | 0.4 | 0.8 |
| PAPER BASE | 0.5 | 1.0 |

LIQUID DISCHARGING APPARATUS AND IMAGE FORMING METHOD

This application claims priority to Japanese Patent Application No. 2008-330977, filed Dec. 25, 2008 the entirety of which is incorporated by reference herein.

BACKGROUND

1. Technical Field

The present invention relates to a liquid discharging apparatus and an image forming method.

2. Related Art

There is known a liquid discharging apparatus which performs printing by using liquid (for example, UV ink) which is cured by the irradiation of electromagnetic waves (for example, ultraviolet rays (UV)). In such a liquid discharging apparatus, the liquid is discharged from nozzles onto a medium, and then the electromagnetic waves are irradiated to dots formed on the medium. Due to this, the dots are cured and fixed to the medium, so that it is possible to perform excellent printing even on a medium which is hard for liquid to be absorbed (for example, refers to JP-A-2000-158793).

However, in the case of performing printing by such a liquid discharging apparatus, there is a fear that the optimum irradiation amount of the electromagnetic waves for the curing of the dots will vary according to printing conditions (for example, a printing mode or the kind of medium). Nevertheless, if the dots are cured by the same irradiation amount, there was a problem that a difference occurs in the image quality of a printed image.

SUMMARY

An advantage of some aspects of the invention is that it reduces differences in the image quality of a printed image.

According to a first aspect of the invention, there is provided a liquid discharging apparatus including: nozzles which discharge liquid which is cured by the irradiation of electromagnetic waves; an irradiation section which irradiates the electromagnetic waves to dots formed on a medium by the liquid discharged from the nozzles; and a controller which controls the discharging of the liquid from the nozzles and changes the irradiation amount of the electromagnetic waves that the irradiation section irradiate, according to methods of forming the dots.

Other aspects of the invention will become apparent from the description of this specification and the accompanying drawings.

SUMMARY OF DISCLOSURE

At least the following aspects will become apparent from the description of this specification and the accompanying drawings.

A liquid discharging apparatus will become apparent which includes nozzles which discharge liquid which is cured by the irradiation of electromagnetic waves, an irradiation section which irradiates the electromagnetic waves to dots formed on a medium by the liquid discharged from the nozzles, and a controller which controls the discharging of the liquid from the nozzles and changes the irradiation amount of the electromagnetic waves that the irradiation section irradiates, according to methods of forming the dots. According to such a liquid discharging apparatus, a difference in the image quality of a printed image can be reduced.

In the liquid discharging apparatus, it is preferable that the irradiation section include a preliminary irradiation section which irradiates the electromagnetic waves of a first irradiation amount which suppresses dots spreading, and a main irradiation section which irradiates the electromagnetic waves of a second irradiation amount larger than the first irradiation amount after the irradiation by the preliminary irradiation section, and the controller changes the first irradiation amount of the preliminary irradiation section. According to such a liquid discharging apparatus, the spreading of dots can be controlled by the first irradiation amount, so that image quality can be adjusted.

In the liquid discharging apparatus, it is preferable that the dots be formed on the medium by alternately repeating a liquid discharging operation which discharges liquid from a nozzle row, in which a plurality of nozzles are arranged in a given direction, while relatively moving the nozzle row with respect to the medium in a direction crossing the given direction, and a transportation operation which transports the medium in the given direction, and the preliminary irradiation section moves in a direction crossing the given direction along with the nozzle row during the liquid discharging operation so as to irradiate the electromagnetic waves to the dots formed on the medium. According to such a liquid discharging apparatus, the dots can be cured immediately after the forming of the dots, so that the occurrence of differences in image quality in a moving direction can be prevented.

In the liquid discharging apparatus, it is preferable that the method of forming the dots be based on whether or not the dots are formed at adjacent pixels on the medium by the same liquid discharging operation. According to such a liquid discharging apparatus, differences in image quality between the case where the dots are formed in an overlapping manner and the case where the dots are formed in a non-overlapping manner can be reduced.

In the liquid discharging apparatus, it is preferable that the controller further changes the irradiation amount of the electromagnetic waves which the irradiation section irradiates, according to the kind of medium. According to such a liquid discharging apparatus, differences in the image quality of a printed image can be further reduced.

In the liquid discharging apparatus, it is preferable that in a first dot forming method and a second dot forming method, the same driving signal be used in order to discharge liquid from the nozzles. According to such a liquid discharging apparatus, even if the driving signals are the same, it is possible to adjust image quality by the irradiation amount of the electromagnetic waves. Therefore, printing can be further simply and easily performed.

The liquid discharging apparatus is effective in the case where the electromagnetic waves are ultraviolet rays and the liquid is ultraviolet cure type ink which is cured by being subjected to the irradiation of the ultraviolet rays.

Further, an image forming method of a liquid discharging apparatus will become apparent, where an image is formed on a medium by discharging liquid from nozzles, the method including: discharging liquid, which is cured by the irradiation of electromagnetic waves, from the nozzles; and irradiating the electromagnetic waves to dots formed on the medium by the liquid discharged from the nozzles, wherein the irradiation amount of the electromagnetic waves is changed according to methods of forming the dots.

BRIEF DESCRIPTION OF THE DRAWINGS

The invention will be described with reference to the accompanying drawings, wherein like numbers reference like elements.

FIG. 10 is an explanatory view of the decision criteria of FIG. 9.

FIG. 14 is a view showing the experimental results for every kind of medium.

FIG. 15 is a view showing the relationship between the input current of an LED and UV irradiation energy.

FIG. 16 is a view showing the experimental results of a second embodiment.

DESCRIPTION OF EXEMPLARY EMBODIMENTS

In the following embodiments, an ink jet printer (hereinafter, also referred to as a printer 1) is taken and explained as an example of a liquid discharging apparatus.

Concerning Printer of Embodiment

Figure 1:
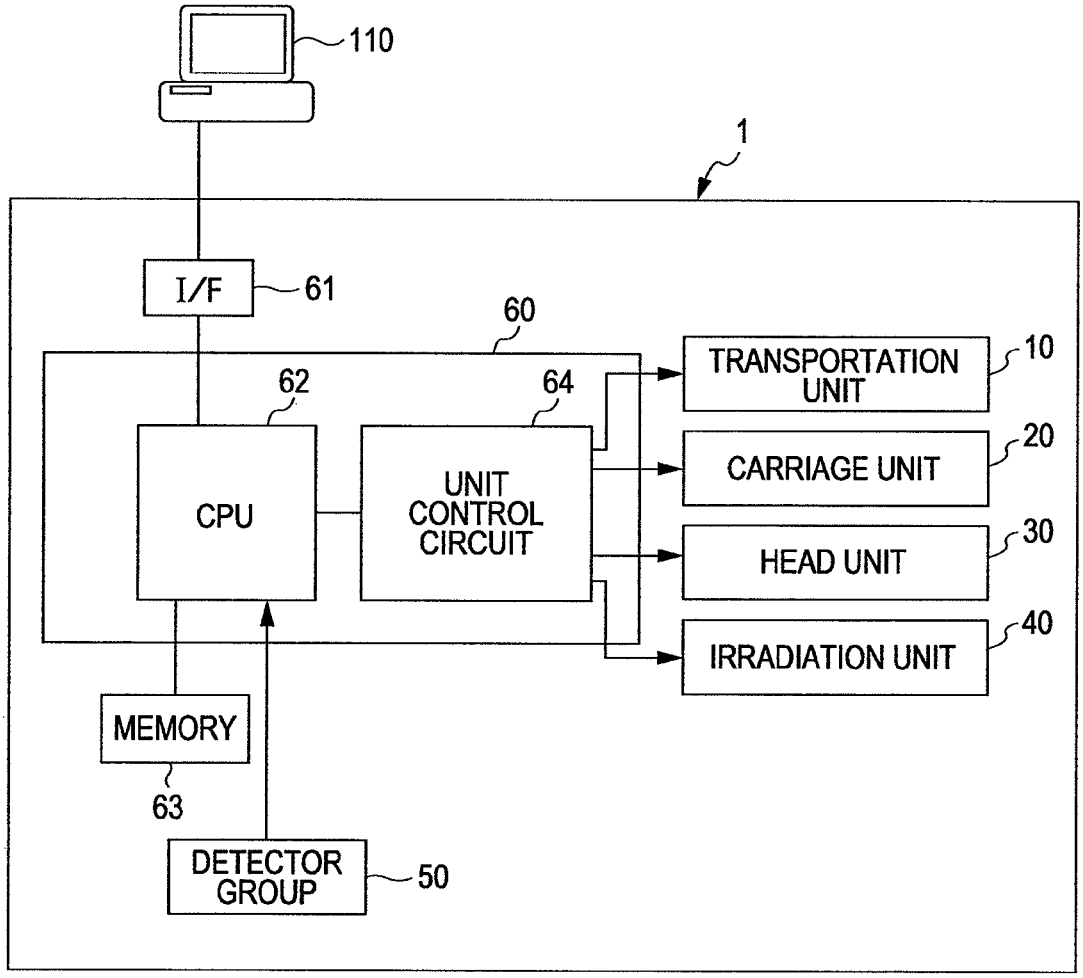
FIG. 1 is a block diagram showing the configuration of a printer.
Figure 2:
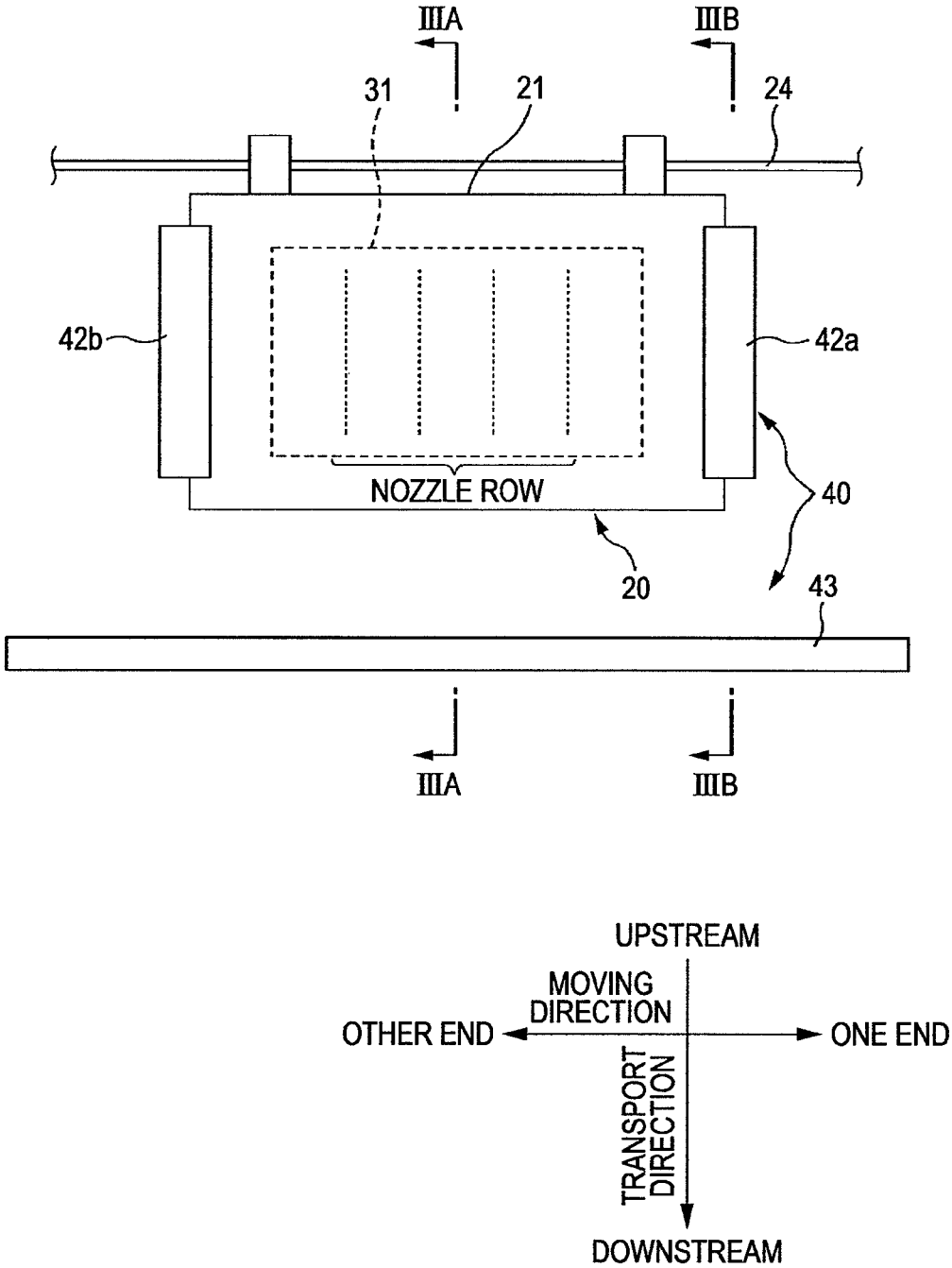
FIG. 2 is a schematic view of the periphery of a head of the printer.
Figure 3A:
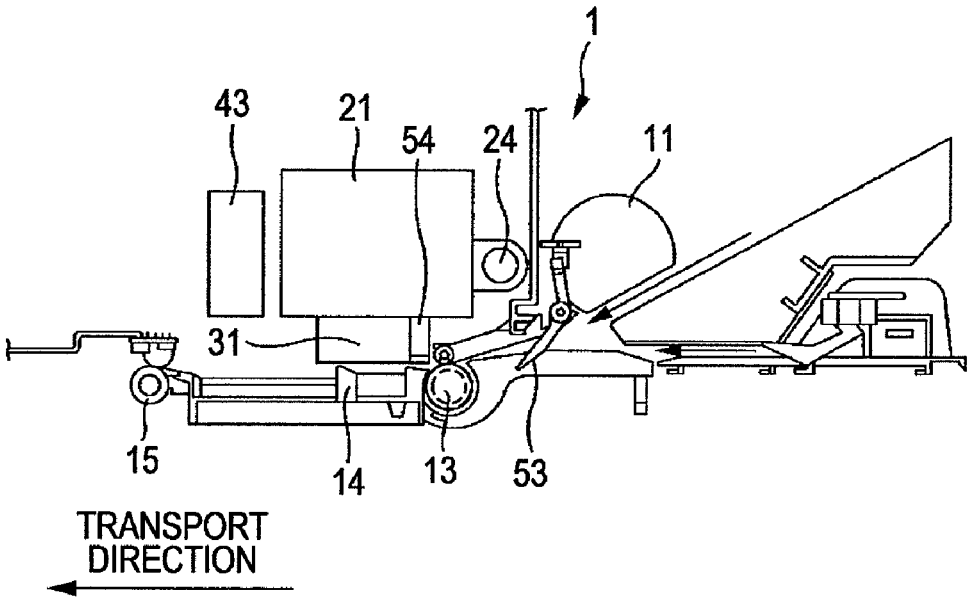
FIGS. 3A and 3B are transverse cross-sectional views of the printer.
Figure 3B:
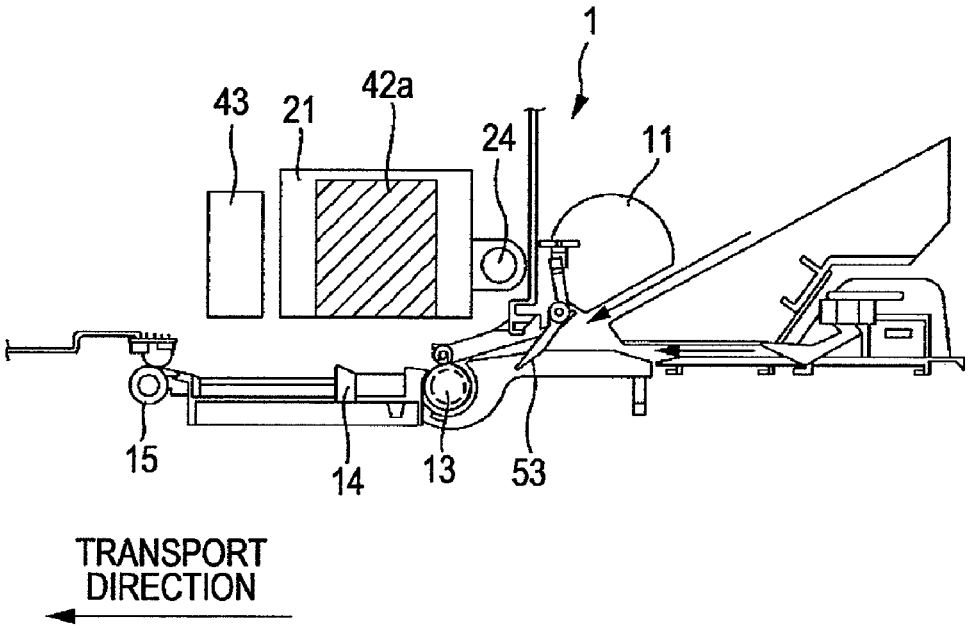

Hereinafter, the printer 1 of this embodiment will be explained with reference to FIGS. 1, 2, 3A, and 3B. FIG. 1 is a block diagram showing the configuration of the printer 1. FIG. 2 is a schematic view of the periphery of a head of the printer 1. FIGS. 3A and 3B are transverse cross-sectional views of the printer 1. FIG. 3A corresponds to a cross-section taken along line IIIA-IIIA of FIG. 2, and FIG. 3B corresponds to a cross-section taken along line IIIB-IIIB of FIG. 2.

The printer 1 of this embodiment is an apparatus which prints an image on a medium such as paper, cloth, or film sheets by discharging ultraviolet cure type ink (hereinafter referred to as UV ink), as one example of liquid, which is cured by the irradiation of ultraviolet rays (hereinafter referred to as UV), toward the medium. The UV ink is ink including ultraviolet curable resin and cured by photopolymerization reaction which occurs in the ultraviolet curable resin when it is subjected to the UV irradiation. Also, the printer 1 of this embodiment prints an image by using the UV ink of four colors, C, M, Y, and K.

The printer 1 has a transportation unit 10, a carriage unit 20, a head unit 30, an irradiation unit 40, a detector group 50, and a controller 60. When the printer 1 receives print data from a computer 110 which is an external apparatus, the printer controls each of the units (the transportation unit 10, the carriage unit 20, the head unit 30, and the irradiation unit 40) by using the controller 60. The controller 60 controls each unit on the basis of the print data received from the computer 110, so as to print an image on the medium. The conditions in the printer 1 are monitored by the detector group 50, and the detector group 50 outputs detection results to the controller 60. The controller 60 controls each unit on the basis of the detection results outputted from the detector group 50.

The transportation unit 10 is a unit for transporting the medium (for example, paper) in a given direction (hereinafter referred to as a transport direction). The transportation unit 10 has a paper feeding roller 11, a transportation motor (not shown), a transportation roller 13, a platen 14, and a paper discharging roller 15. The paper feeding roller 11 is a roller for feeding the medium inserted into a paper insertion port into the printer. The transportation roller 13 is a roller which transports the medium fed by the paper feeding roller 11 up to a printable region, and is driven by the transportation motor. The platen 14 supports the medium during printing. The paper discharging roller 15 is a roller which discharges the medium from the printer, and is provided on the downstream side of the transport direction with respect to the printable region.

The carriage unit 20 is a unit for moving (also referred to as "scanning") a head in a given direction (hereinafter referred to as a moving direction). The carriage unit 20 has a carriage 21 and a carriage motor (not shown). Also, the carriage 21 detachably holds an ink cartridge which contains UV ink. Then, the carriage 21 reciprocates along a guide shaft 24, which crosses a transport direction described later, by the carriage motor in a state in which it is supported on the guide shaft 24.

The head unit 30 is a unit for discharging liquid (in this embodiment, UV ink) to the medium. The head unit 30 is provided with a head 31 having a plurality of nozzles. Since the head 31 is provided on the carriage 21, when the carriage 21 moves in the moving direction, the head 31 also moves in the moving direction. Also, the head 31 intermittently discharges UV ink during movement in the moving direction, so that a dot line (raster line) along the moving direction is formed on the medium. In addition, hereinafter, in regard to the movement of the head 31, movement from one end side of FIG. 2 toward the other end side is called forward movement, and movement from the other end side to one end side is called backward movement. In this embodiment, during the forward movement, the discharging of UV ink is performed, and during the backward movement, the discharging of UV ink is not performed. In addition, the configuration of the head 31 will be described later.

The irradiation unit 40 is a unit for irradiating UV toward UV ink landed on the medium. The dots formed on the medium are cured by being subjected to the UV irradiation from the irradiation unit 40. The irradiation unit 40 of this embodiment includes irradiation sections 42*a* and 42*b* for provisional curing and an irradiation section 43 for main curing. In this embodiment, the irradiation sections 42*a* and 42*b* for provisional curing correspond to a preliminary irradiation section, and the irradiation sections 43 for main curing correspond to a main irradiation section. In addition, the details of the irradiation sections 42*a* and 42*b* for provisional curing and the irradiation section 43 for main curing will be described later.

In the detector group 50, a linear type encoder (not shown), a rotary type encoder (not shown), a paper detection sensor 53, an optical sensor 54, and the like are included. The linear type encoder detects the position in the moving direction of the carriage 21. The rotary type encoder detects the rotation amount of the transportation roller 13. The paper detection sensor 53 detects the position of the leading end of the paper which is being fed. The optical sensor 54 detects the presence or absence of paper by a light emitting portion and a light receiving portion, which are attached to the carriage 21. Also, the optical sensor 54 can detect the positions of the end portions of paper which is being moved by the carriage 21, so as to detect the width of the paper. Further, the optical sensor 54 can also detect the leading end (the end portion on the downstream side of the transport direction and also called the upper end) and the trailing end (the end portion on the upstream side of the transport direction and also called the lower end) of paper according to the conditions.

The controller 60 is a control unit (control section) for performing the control of the printer 1. The controller 60 has an interface portion 61, a CPU 62, a memory 63, and a unit control circuit 64. The interface portion 61 performs the transmission and receiving of data between the computer 110, which is an external apparatus, and the printer 1. The CPU 62 is an arithmetic processing device for performing the control of the entire printer 1. The memory 63 is for securing a region which stores the program of the CPU 62, a work region, and the like, and has storage elements such as a RAM and an EEPROM. The CPU 62 controls each unit through the unit control circuit 64 in accordance with the program stored in the memory 63.

When performing printing, the controller 60 alternately repeats a dot forming operation which discharges UV ink from the head 31 which is moving in the moving direction, as described later, and a transportation operation which transports paper in the transport direction, thereby printing an image constituted of a plurality of dots on the paper. In addition, hereinafter, the dot forming operation is called a "pass".

Concerning Configuration of Head 31

Figure 4:
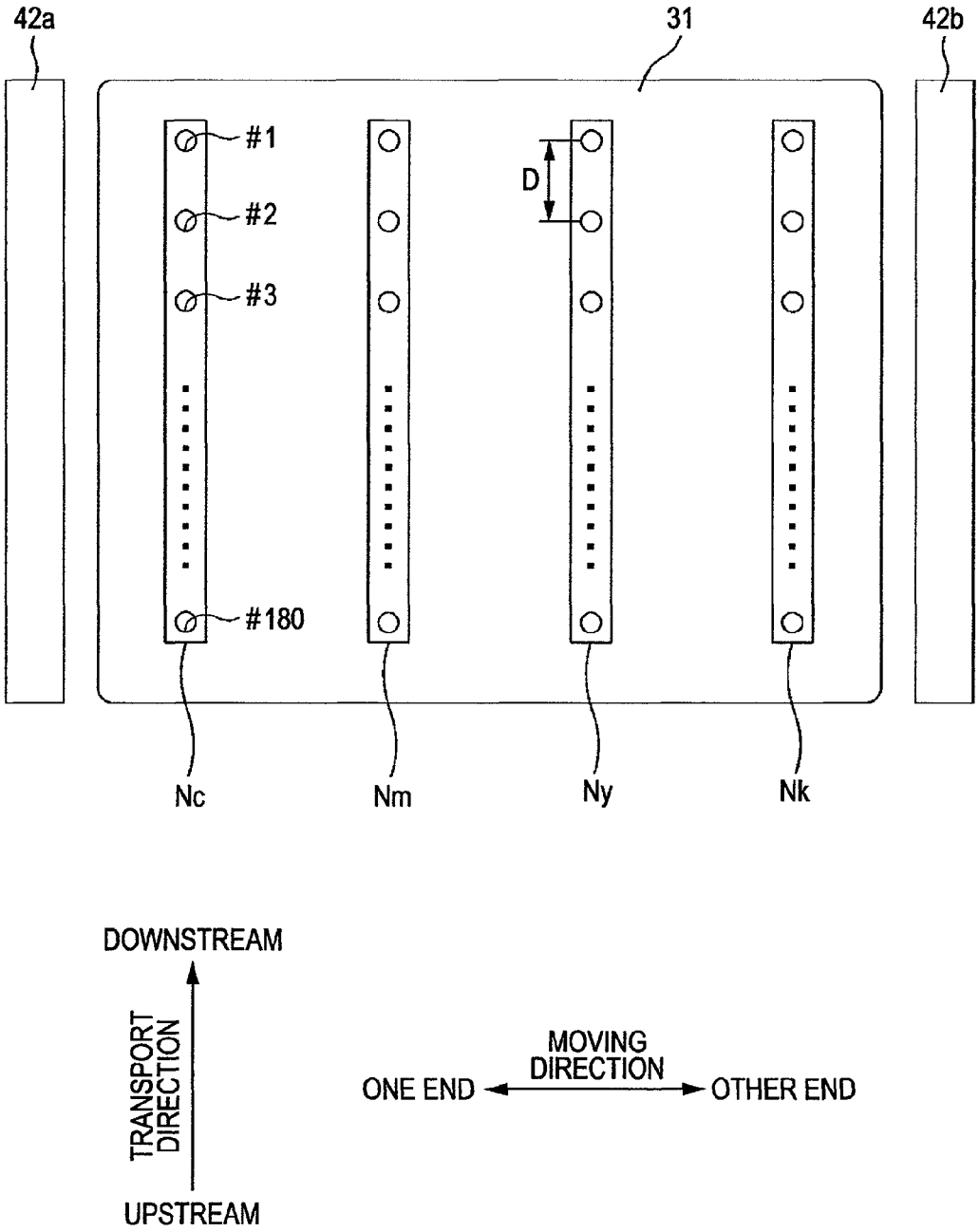
FIG. 4 is an explanatory view of the configuration of the head.

FIG. 4 is an explanatory view of one example of the configuration of the head 31. The lower surface of the head 31 is provided with a plurality of nozzles for discharging UV ink. The head 31 of this embodiment has a plurality of nozzles for each ink color, C, M, Y, and K, as shown in FIG. 4. The plurality of nozzles are arranged at a constant nozzle pitch in a direction (transport direction) crossing the moving direction of the carriage 21. In this manner, in the head 31, nozzle rows Nc, Nm, Ny, and Nk for four colors, C, M, Y, and K are formed.

In this embodiment, in each nozzle row, 180 nozzles arranged in the transport direction are provided at a nozzle pitch D (for example, 360 dpi). Also, the nozzles of each nozzle row are numbered in descending order toward the nozzle on the downstream side in the transport direction. In each nozzle, a piezo element (not shown) is provided as a driving element for discharging UV ink from each nozzle. UV ink in the form of dots is ejected from each nozzle by driving the piezo element by a driving signal. The discharged UV ink lands on the medium, thereby forming a dot.

Concerning Provisional Curing and Main Curing

In this embodiment, the dots are cured by irradiating UV to the UV ink landed on the medium. In the printer 1 of this embodiment, as the irradiation unit 40, the irradiation sections 42*a* and 42*b* for provisional curing, which perform UV irradiation for the provisional curing of the UV ink, and the irradiation section 43 for main curing, which performs UV irradiation for the main curing of the UV ink, are provided, so that 2-step curing is performed. In addition, the provisional curing is for suppressing the flow (spread of dots) of UV ink which has landed on the medium, and the main curing is for completely curing the UV ink. UV irradiation energy (that is, the irradiation amount of UV) is set to be larger in the main curing than in the provisional curing. The irradiation sections 42*a* and 42*b* for provisional curing and the irradiation section 43 for main curing are respectively provided with a light source for irradiating UV toward the medium.

The irradiation sections 42*a* and 42*b* for provisional curing are mounted on the carriage 21, as shown in FIGS. 2 and 4. The irradiation section 42*a* for provisional curing is provided on one end side in the moving direction of the carriage 21, and the irradiation section 42*b* for provisional curing is provided on the other end side in the moving direction of the carriage 21. Accordingly, the head 31 and the irradiation sections 42*a* and 42*b* for provisional curing integrally move in the moving direction with the moving of the carriage 21. In other words, when the nozzle row for each color of the head 31 reciprocates, the irradiation sections 42*a* and 42*b* for provisional curing reciprocate while maintaining their relative positions with respect to the nozzle row for each color. At this time, UV is irradiated from the irradiation sections 42*a* and 42*b* for provisional curing toward the medium. Specifically, during the forward movement, UV is irradiated from the irradiation section 42*a* for provisional curing, and during the backward movement, UV is irradiated from the irradiation section 42*b* for provisional curing. In this manner, the provisional curing is performed in the period when the head 31 moves in the moving direction, and performed in the same pass as the formation of the dots. Also, the light sources of the irradiation sections 42*a* and 42*b* for provisional curing are respectively contained in the irradiation sections 42*a* and 42*b* for provisional curing, thereby being isolated from the head 31. Therefore, UV which is irradiated from the light sources is prevented from being leaked to the lower surface of the head 31, and thus UV ink is prevented from being cured in the proximity of the opening of each nozzle formed in the lower surface (nozzle clogging is prevented).

The irradiation section 43 for main curing is provided on the downstream side of the head 31 in the transport direction and is set to be longer in length in the moving direction than the width of the medium which is a printing object. Also, the irradiation section 43 for main curing irradiates UV toward the medium without moving. By this configuration, when the medium on which the dots have been formed by the pass is transported up to under the irradiation section 43 for main curing by the transportation operation, the medium is subjected to the UV irradiation by the irradiation section 43 for main curing.

Further, the irradiation by the irradiation section 43 for main curing may also be performed when the medium has reached the irradiation section 43 for main curing by the transportation which is alternated with the pass, or when the irradiation section 43 for main curing is further downstream in the transport direction and the medium has reached the irradiation section 43 for main curing by the transportation operation which discharges the medium after a given printing of 1 page, etc. has been completed.

Also, it is preferable if the main curing sufficiently cures a printed matter after printing, with an irradiation amount above the necessary amount for the use of the printed matter, and the influence on print quality according to the irradiation conditions of the main curing is not more than the influence according to the irradiation conditions of the provisional curing.

Also, in this embodiment, as the light sources of the irradiation sections 42*a* and 42*b* for provisional curing, a light emitting diode (LED) is used. The LED can easily change irradiation energy by controlling the magnitude of input current. Also, as the light source of the irradiation section 43 for main curing, a lamp (metal halide lamp, mercury lamp, or the like) is used.

Concerning Procedure for Printing

The controller 60 carries out the following processing on each unit of the printer 1 when printing the print data received from the computer 110.

First, the controller 60 rotates the paper feeding roller 11 so as to send the medium (here, paper S) to be printed up to the transportation roller 13. Next, the controller 60 rotates the transportation roller 13 by driving the transportation motor (not shown). If the transportation roller 13 rotates by a given rotation amount, the paper S is transported by a given transportation amount.

When the paper S has been transported up to below the head 31, the controller 60 rotates the carriage motor (not shown). The carriage 21 moves in the moving direction in accordance with the rotation of the carriage motor. Also, in accordance with the movement of the carriage 21, the head 31 and the irradiation sections 42*a* and 42*b* for provisional curing, which are provided on the carriage 21, also simultaneously move in the moving direction. Then, the controller 60 intermittently discharges ink drops from the head 31 during the movement (forward movement) of the head 31 in the moving direction. The ink drops land on the paper S, so that a dot row with a plurality of dots arranged in the moving direction is formed.

Also, the controller 60 carries out UV irradiation from the irradiation section 42*a* for provisional curing during the forward movement of the head 31, and carries out UV irradiation from the irradiation section 42*b* for provisional curing during the backward movement of the head 31. By the UV irradiation, the flowing of dots on the paper S is controlled.

Also, the controller 60 drives the transportation motor during the reciprocation of the head 31. The transportation motor generates a drive force in a rotation direction in accordance with the commanded drive amount from the controller 60. Then, the transportation motor rotates the transportation roller 13 by using the drive force. If the transportation roller 13 rotates by a given rotation amount, the paper S is transported by a given transportation amount. That is, the transportation amount of the paper S is determined in accordance with the rotation amount of the transportation roller 13. In this manner, the reciprocation of the head 31 and the transportation of the paper S are alternately and repeatedly carried out, so that the dots are formed at the pixels of the paper S.

Then, the controller 60 carries out UV irradiation from the irradiation section 43 for main curing toward the medium which passes under the irradiation section 43 for main curing by the transportation operation. By the UV irradiation, the dots on the paper S are completely cured, and thus fixed to the medium.

The paper S on which printing has been completed is discharged by the paper discharging roller 15 which rotates in synchronization with the transportation roller 13. Thus, an image is printed on the paper S.

First Embodiment

In the printer 1 of this embodiment, UV ink is cured by the 2-step curing of the provisional curing and the main curing, as described above. Here, the provisional curing is to control the flowing (spread) of UV ink landed on the medium, and by the provisional curing, the shape of the dots is almost determined. In other words, the image quality of a printed image is changed by the provisional curing.

Figure 5A:
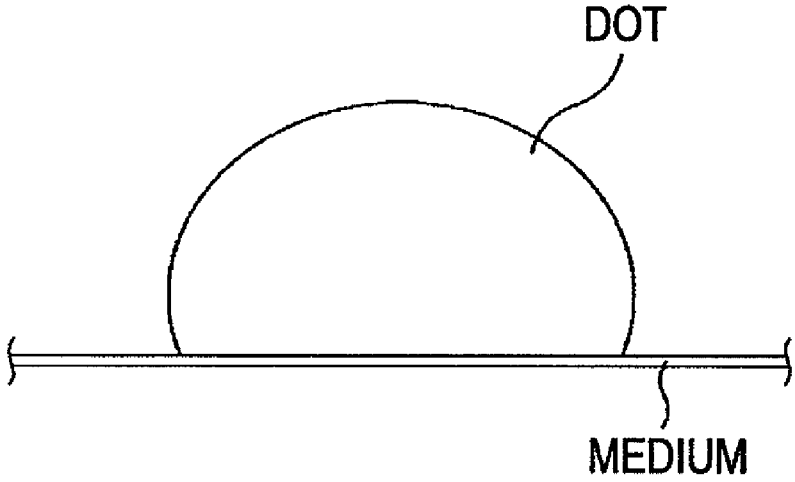
FIGS. 5A and 5B are schematic views for explaining differences in dot shape due to provisional curing.
Figure 5B:
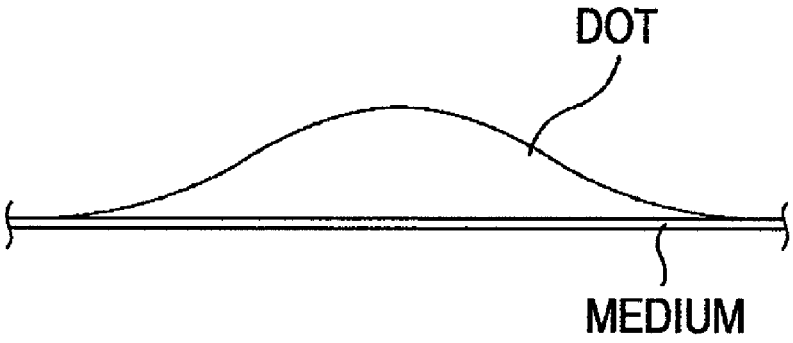

FIGS. 5A and 5B are schematic views for explaining differences in dot shapes due to the provisional curing. If UV irradiation energy during the provisional curing is high, for example, as shown in FIG. 5A, the flowing of the dots is smaller. In this case, low gloss (mat tone) image quality is obtained in which the gloss of a surface was suppressed. On the other hand, if UV irradiation energy during the provisional curing is low, for example, as shown in FIG. 5B, the flowing of the dots is larger. In this case, high gloss (gloss tone) image quality is obtained in which the gloss of a surface was increased.

In the first embodiment, with respect to cases where the dot forming methods are different, printing was carried out by changing UV irradiation conditions. As the dot forming method, a printing method (hereinafter also referred to as 2-pass) which performs the printing of a region (2 raster lines) of a nozzle pitch length by two passes, and a printing method (hereinafter also referred to as 4-pass) which performs the printing by four passes were used. Also, with respect to the respective cases, optimum UV irradiation conditions were determined. The 2-pass dot forming method and the 4-pass dot forming method are described below.

2-Pass Dot Forming Method

First, the 2-pass dot forming method is explained.

Figure 6:
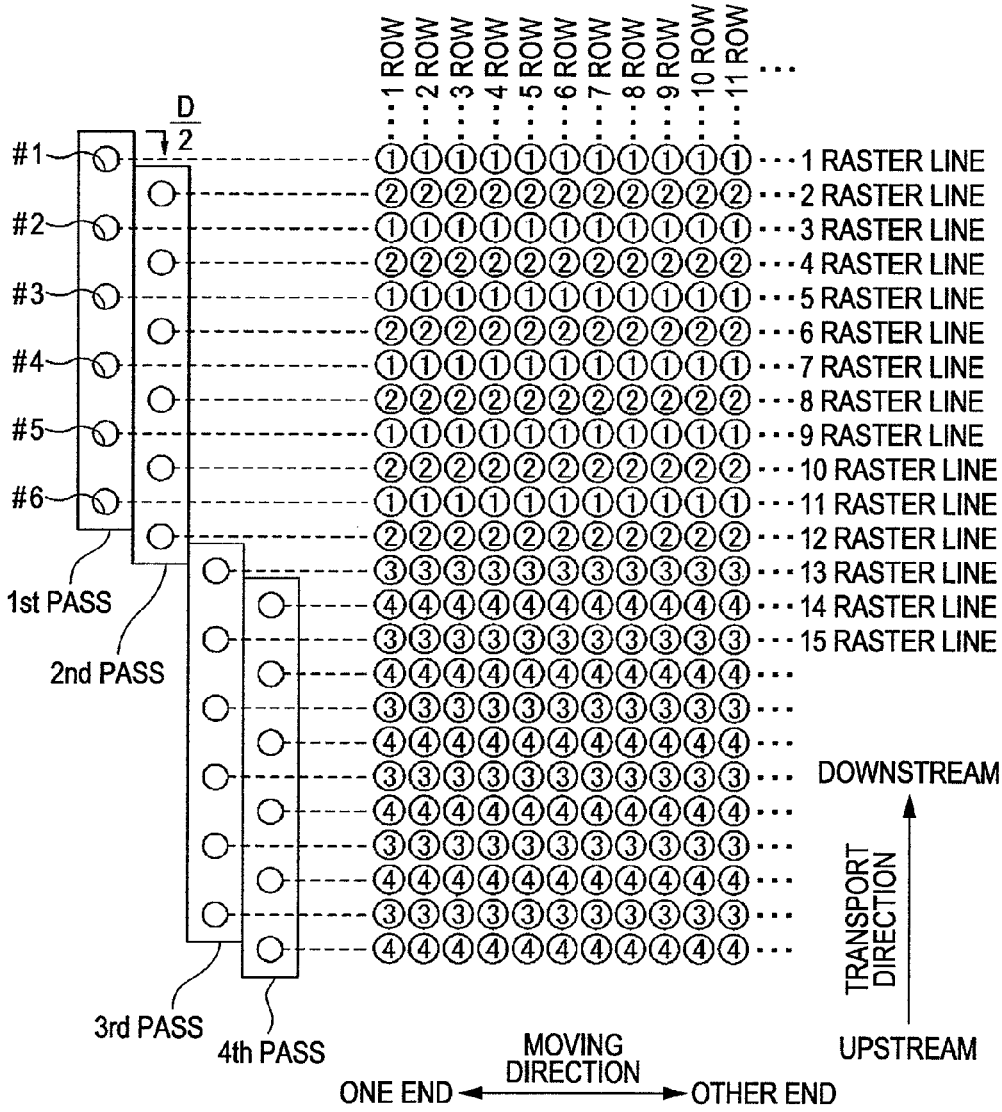
FIG. 6 is an explanatory view of a 2-pass dot forming method.

FIG. 6 is an explanatory view of the 2-pass dot forming method. In this drawing, for simplification of explanation, one nozzle row (for example, black nozzle row) among four nozzle rows is shown. Also, for simplification of explanation, the number of nozzles of the nozzle row is set to be 6.

Also, as described above, when performing the printing, the controller 60 alternately and repeatedly performs the dot forming operation (pass) which discharges ink from the head 31 which is moving in the moving direction, and the transportation operation which transports the medium in the transport direction. The circles on the right side of the drawing indicate the dots, and the numerals in the circles indicate the number of the pass in which the dots were formed.

In the first pass, the controller 60 discharges ink from each nozzle while moving the head 31 in the moving direction, and therefore, the dots (circles having numeral 1) are formed at the positions (odd-number raster lines) corresponding to the nozzles on the medium. In the transportation operation after the first pass, the controller 60 transports the medium by half (D/2=0.5D) of the nozzle pitch D in the transport direction, and therefore, the relative position of the head with respect to the medium is shifted by 0.5D to the upstream side of the transportation direction.

Then, also in the second pass, by discharging ink from each nozzle while moving the head 31 in the moving direction, the dots (circles having numeral 2) are formed at the positions (even-number raster lines) corresponding to the nozzles on the medium. As seen in the drawing, in the second pass, for example, the dot row (2 RASTER LINE) is formed by nozzle #1 between the dot row (1 RASTER LINE) formed by nozzle #1 and the dot row (3 RASTER LINE) formed by nozzle #2 during the first pass. In the transportation operation after the second pass, by moving the medium by 5.5D (=6D−0.5D) in the transport direction, the relative position of the head 31 with respect to the medium is shifted by 5.5D to the upstream side of the transportation direction. That is, as shown in FIG. 6, 12 RASTER LINE formed by nozzle #6 in the second pass is positioned at a position shifted by 0.5D from the raster line formed by nozzle #1 to the downstream side of the transport direction.

Then, also in the third pass, by discharging ink from each nozzle while moving the head 31 in the moving direction, the dots (circles having numeral 3) are formed at the positions (odd-number raster lines) corresponding to the nozzles on the medium. For example, below the raster line (12 RASTER LINE) formed by nozzle #6 in the second pass, a raster line (13 RASTER LINE) is formed by nozzle #1 in the third pass.

In the transportation operation after the third pass, by transporting the medium by half (D/2=0.5D) of the nozzle pitch D, the relative position of the head with respect to the medium is shifted by 0.5D to the upstream side of the transportation direction.

Then, also in the fourth pass, by discharging ink from each nozzle while moving the head 31 in the moving direction, the dots (circles having numeral 4) are formed at the positions (even-number raster lines) corresponding to the nozzles on the medium.

Hereinafter, similarly, the controller 60 transports the medium by 0.5D after the odd-numbered pass, and transports the medium by 5.5D in the transport direction after the even-numbered pass. By repeating the operations, the dot rows arranged in the moving direction and the transport direction are formed on the medium.

4-Pass Dot Forming Method

Next, the 4-pass dot forming method is explained.

Figure 7:
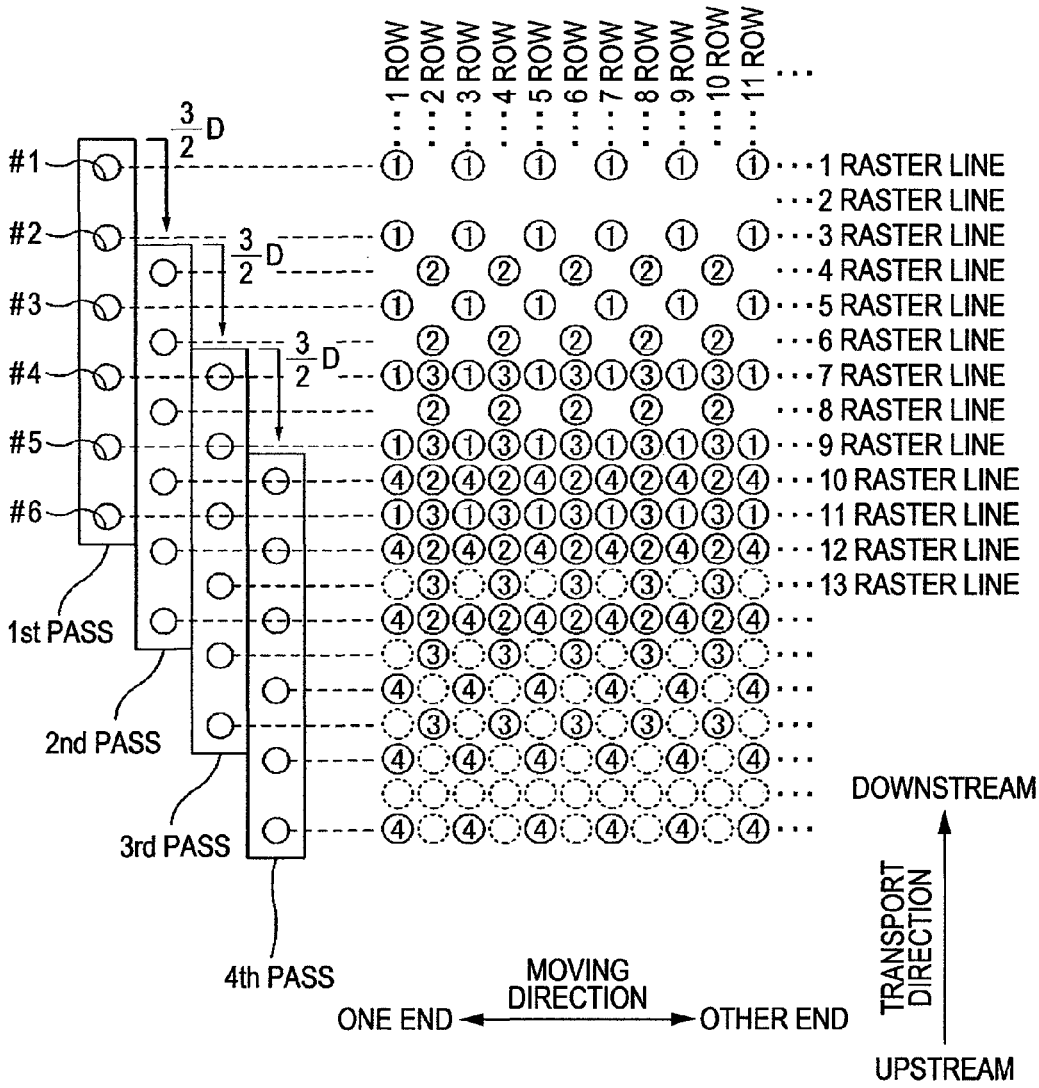
FIG. 7 is an explanatory view of a 4-pass dot forming method.

FIG. 7 is an explanatory view of the 4-pass dot forming method. Also in FIG. 7, similarly to FIG. 6, one nozzle row (for example, black nozzle row) among four nozzle rows is shown. Also in this case, the number of nozzles of the nozzle row is set to be 6.

Also, as described above, when performing the printing, the controller 60 alternately and repeatedly performs the dot forming operation (pass) which discharges ink from the head 31 which is moving in the moving direction, and the transportation operation which transports the medium in the transport direction. The circles on the right side of the drawing indicate the dots, and the numerals in the circles indicate the number of the pass in which the dots were formed. Also, the dotted line circles of the drawing indicate the dots which are formed by passes other than the fourth pass described later.

In the first pass, the controller 60 discharges ink at intervals of 1 pixel from each nozzle while moving the head 31 in the moving direction, and therefore, the dots (circles having numeral 1) are formed at intervals of 1 pixel (for every odd-number row) at the positions (odd-number raster lines) corresponding to the nozzles on the medium. In the transportation operation after the first pass, the controller 60 transports the medium by 3/2D (=1.5D) in the transport direction, and therefore, the relative position of the head with respect to the medium is shifted by 1.5D to the upstream side of the transport direction. For example, nozzle #1 is positioned to correspond to the intermediate position between nozzle #2 and nozzle #3 in the first pass.

Then, also in the second pass, by discharging ink at intervals of 1 pixel from each nozzle while moving the head 31 in the moving direction, the dots (circles having numeral 2) are formed at intervals of 1 pixel (for every even-number row) at the positions (even-number raster lines) corresponding to the nozzles on the medium. In the transportation operation after the second pass, by moving the medium by 1.5D in the transport direction, the relative position of the head with respect to the medium is shifted by 1.5D to the upstream side of the transportation direction.

Then, also in the third pass, by discharging ink from each nozzle while moving the head 31 in the moving direction, the dots (circles having numeral 3) are formed at intervals of 1 pixel at the positions (odd-number raster lines) corresponding to the nozzles on the medium. Also, in the third pass, the dots are formed in the even-number rows. That is, the dot is formed between the dots of the raster line formed in the first pass. Further, also in the transportation operation after the third pass, by moving the medium by 1.5D in the transport direction, the relative position of the head with respect to the medium is shifted by 1.5D to the upstream side of the transportation direction.

Then, also in the fourth pass, by discharging ink at intervals of 1 pixel from each nozzle while moving the head 31 in the moving direction, the dots (circles having numeral 4) are formed at intervals of 1 pixel (for every odd-number row) at the positions (even-number raster lines) corresponding to the nozzles on the paper S. Also, in the fourth pass, the dots are formed in the odd-number rows. That is, the dots are formed between the dots of the raster line formed in the second pass.

Hereinafter, similarly, the pass and the transportation operation are repeated. Thus, as shown in the drawing, the dot rows arranged in the moving direction and the transport direction are formed on the medium (in this case, exactly, from 9 RASTER LINE, the dot row forms a line.

Concerning Test Pattern

Figures 8, 9:
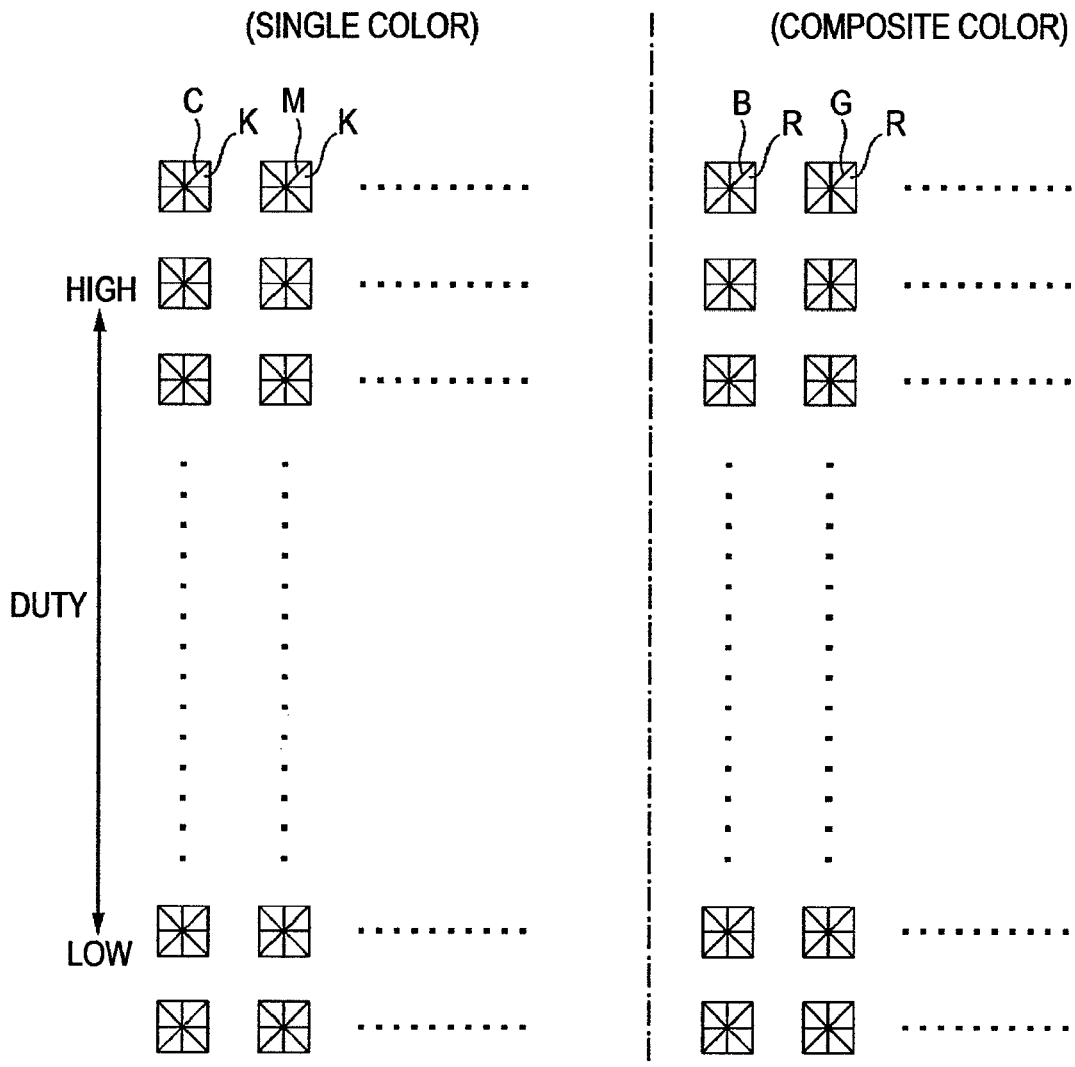
FIG. 8 is a view showing a test pattern used in the evaluation of image quality.
FIG. 9 is a view showing the evaluation results of image quality in the case of the 4-pass dot forming method.

FIG. 8 is a view showing one example of a test pattern used in the evaluation of image quality. In the drawing, a pattern of a single color (C, M, Y, or K) which is formed by ink of a single color, and a pattern of a composite color (for example, R, G, B, or the like) which is formed by ink of a plurality of colors are printed in a plurality of numbers with the duty (ink weight per unit area) being changed.

In the row arranged at the left end in the pattern of a single color of FIG. 8, a line portion is printed by cyan (C), and a portion other than the line is printed by black (K). Further, in adjacent row on the right side of the row, a line portion is printed by magenta (M), and a portion other than the line is printed by black (K). Further, the duty is set to become higher on the upper side of the drawing and lower on the lower side. For example, in the uppermost stage, the duty is 100%, and in the lowermost stage, the duty is 5%.

Also, in the row arranged at the left end in the pattern of a composite color of FIG. 8, a line portion is printed by blue (B), and a portion other than the line is printed by red (R). Further, in adjacent row on the right side of the row, a line portion is printed by green (G), and a portion other than the line is printed by red (R). Also here, similarly to the pattern of a single color, the duty is set to become higher on the upper side of the drawing and lower on the lower side.

Concerning Experimental Results

The printing of the test patterns was carried out with the conditions (the input current of the LED) of the provisional curing changed, by two dot forming methods described above, and then image quality was evaluated. Then, the optimum condition of the provisional curing for each dot forming method was sought from the evaluation results. In addition, print resolution is 720 dpi×720 dpi, and the wavelength of the LED is 400 nm. Further, a paper-based medium was used as the medium.

FIG. 9 is a view showing the evaluation results of image quality in the case of the 4-pass dot forming method. Also, FIG. 10 is an explanatory view of the decision criteria of ○, Δ, and x in FIG. 9.

As shown in FIGS. 9 and 10, as image quality evaluation items, the evaluation concerning bleeding, cohesion, filling, and gloss was performed. Bleeding means oozing which occurs at the boundary portion between different colors. Bleeding is evaluated by looking at the boundary between the line of cyan (C) and the portion of black (K), for example, in the case of the row of the left end of the test pattern of FIG. 8.

Also, cohesion means concentration unevenness of similar colors, which is locally generated due to surface tension or the like when printing is performed by discharging ink. If cohesion occurs, printing with a rough feeling, namely, a granular feeling is obtained due to concentration unevenness. Cohesion is evaluated by looking at the portion of black (K), for example, in the case of the row of the left end of the test pattern of FIG. 8.

Also, filling is to evaluate whether or not a stripe (while stripe) is generated in a scanning direction (in this embodiment, the moving direction) when printing a high gradation image such as a so-called solid image. Filling is evaluated in a high duty pattern of a single color. For example, in the case of the row of the left end of the test pattern of FIG. 8, it is evaluated whether or not a stripe is generated in the moving direction at the portion of black (K) by looking at the pattern of the uppermost stage. Further, the evaluation may also be performed by printing a solid image of only a single color (for example, black), not in the test pattern of FIG. 8.

Also, gloss is the evaluation of a surface state of a printed image. If the surface is smooth, gloss is good, and if the surface is irregular, gloss deteriorates. Gloss is also evaluated in a high duty pattern of a single color. Further, gloss may also be evaluated by using a solid image.

In a case where UV irradiation energy during the provisional curing is high, it is difficult for the dot to spread (for example, refers to FIG. 5A). In this case, bleeding and cohesion tend to improve, but there is a possibility that gloss and filling deteriorate. On the other hand, in a case where UV irradiation energy during the provisional curing is low, it is easy for the dots (UV ink) to spread (for example, refers to FIG. 5B). In this case, gloss and filling tend to improve, but there is a possibility that bleeding and cohesion deteriorate. Thus, in this embodiment, the condition (input current) which the evaluation of these items of image quality improves as a whole was chosen.

According to FIG. 9, the case where the input current is 0.5 A and the case where the input current is 0.6 A are best. However, with respect to gloss, the case of 0.5 A where the input current is smaller was excellent. Accordingly, in the case of the 4-pass dot forming method, 0.5 A was chosen as an optimum input current value. The same evaluation was also performed with respect to the case of the 2-pass dot forming method.

Figures 11, 12:
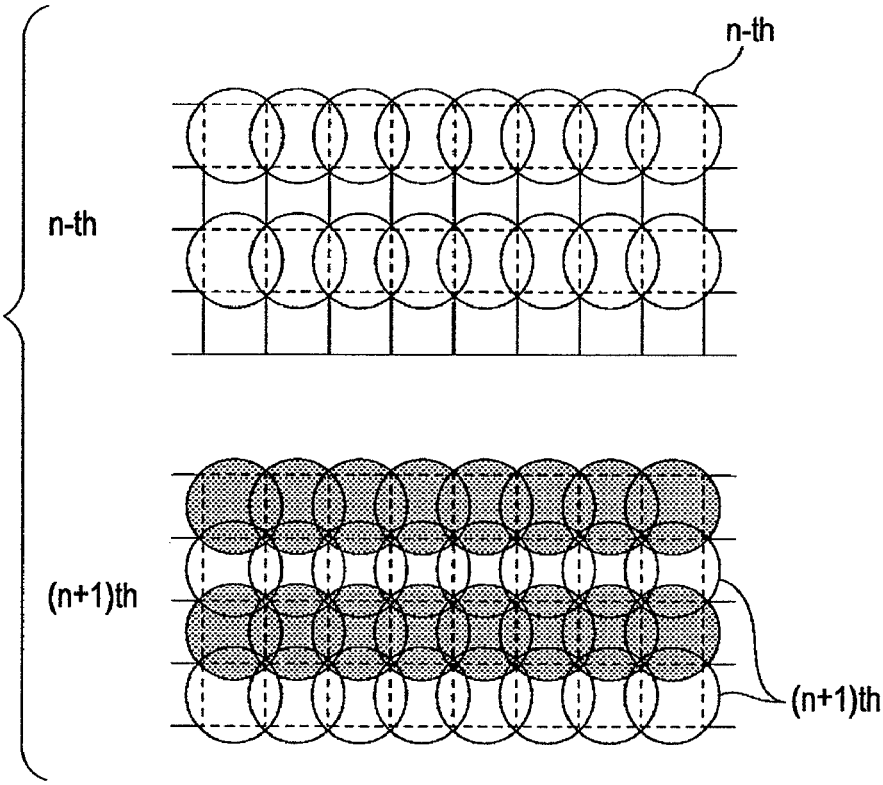
FIG. 11 is a view showing the experimental results of a first embodiment.
FIG. 12 is a schematic view of the 2-pass dot forming method.

FIG. 11 is a view showing the experimental results of the first embodiment. As shown in the drawing, in the 2-pass and the 4-pass dot forming methods, optimum input current values are different. Also, the UV irradiation energy which is irradiated from the LED is dependent on the magnitude of the input current. In the 4-pass dot forming method, optimum input current is 0.5 A, and at this time, the UV irradiation energy is 1.0 ($mW/cm^2$). Also, in the 2-pass dot forming method, optimum input current is 1.0 A, and at this time, the UV irradiation energy is 2.0 ($mW/cm^2$). In this manner, optimum UV irradiation energy during the provisional curing of UV ink is larger in the case of the 2-pass than the case of the 4-pass dot forming method. Accordingly, if images are printed by using the same UV irradiation energy in the cases of the 2-pass and the 4-pass dot forming methods, differences occur in the image quality of the images.

In this manner, the optimum value of UV irradiation energy varies according to the dot forming methods (2-pass and 4-pass). The reasons are examined below.

Concerning Comparison Between 2-Pass and 4-Pass Dot Dorming Methods

The length of one side of the pixel of this embodiment is 720 dpi. This corresponds to approximately 35 vim and is smaller than a dot size by UV ink of this embodiment. A difference in optimum UV irradiation energy in the 2-pass and the 4-pass dot forming methods was examined in consideration of the above.

Figure 13:
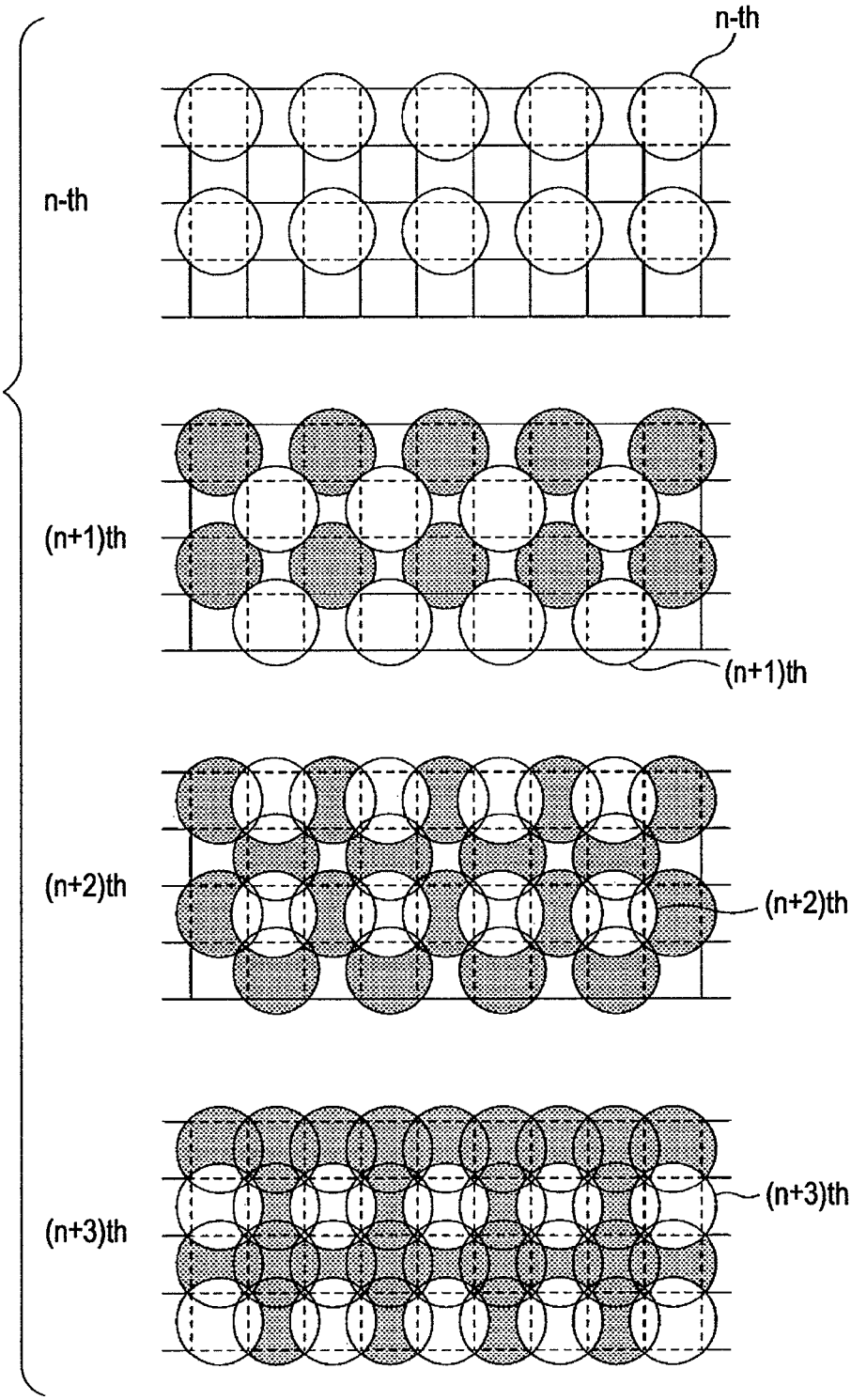
FIG. 13 is a schematic view of the 4-pass dot forming method.

FIG. 12 is a schematic view of the 2-pass dot forming method, and FIG. 13 is a schematic view of the 4-pass dot forming method. Further, each of regions partitioned by straight lines in FIGS. 12 and 13 indicates a pixel. Also, the circle in the drawings indicates a dot, the white circle indicates a dot which is not yet provisionally cured, and the gray circle indicates a dot which was provisionally cured.

In the 2-pass dot forming method, as shown in FIG. 12, dots (dot row) are formed at the pixels arranged in the moving direction in a certain pass (n-th pass). The dot rows are formed at intervals of 1 pixel in the transport direction. Then, in the subsequent (n+1)th pass, a dot row is formed between the dot rows formed in the n-th pass. At this time, the dots formed in the n-th pass have been provisionally cured. In this manner, in the 2-pass, the dots which are adjacent to each other in the moving direction are formed in an overlapping manner in the same pass. In this case, the dots which are not provisionally cured are formed in an overlapping manner. Then, the provisional curing is performed in a state where the dots overlap.

In contrast to this, in the 4-pass dot forming method, as shown in FIG. 13, dots are formed at intervals of 1 pixel with respect to each of the transport direction and the moving direction in each pass. Also, the dot forming positions are different in the four passes (n, n+1, n+2, and n+3). Further, in the same pass, dots are not formed at the pixels which are adjacent to each other in the transport direction and the moving direction. Also, during a certain pass, the dots formed in the previous pass have been provisionally cured. In this manner, in the 4-pass dot forming method, dots which are formed by the same pass do not overlap each other, and the overlapping of dots is made only with respect to the dots which were already provisionally cured (formed in the previous pass).

Therefore, the reason why the necessary UV irradiation energy for the provisional curing in the 2-pass dot forming method is larger is considered to be due to the fact that the dots are formed in an overlapping manner before the provisional curing is performed.

The data representing the above-mentioned experimental results is stored, for example, in the memory 63 of the printer 1. Then, during printing, the controller 60 of the printer 1 changes the input current to the irradiation sections 42*a* and 42*b* for provisional curing in accordance with the dot forming methods (in this case, the 2-pass and the 4-pass dot forming methods) with reference to the data stored in the memory 63, thereby changing UV irradiation energy (that is, the UV irradiation amount). For example, in this embodiment, in the case of forming dots by the 2-pass dot forming method, the input current of the LED is set to be 2 times the magnitude of the case of forming dots by the 4-pass dot forming method. Therefore, a difference in the image quality of the printed images in the case of performing printing by the 2-pass dot forming method and the case of performing printing by the 4-pass dot forming method can be reduced.

Also, in this embodiment, image quality is adjusted only by changing the input current to the LED without changing the discharge amount of UV ink. That is, since it is not necessary to change the wave shape of the driving signal for discharging UV ink from the nozzles, printing can be easily performed.

Further, although in this embodiment, the UV irradiation energy for the provisional curing is changed in accordance with the number of passes, the UV irradiation energy may also be changed in accordance with the overlapping extent of the dots which are formed in the same pass irrespective of the number of passes. For example, the UV irradiation energy may also be changed in accordance with whether or not dots are formed at adjacent pixels in the same pass. It is preferable if the UV irradiation energy is set to be large in a case where dots are formed at adjacent pixels in the same pass, and to be small in a case where dots are not formed at adjacent pixels in the same pass.

Second Embodiment

In the first embodiment, with respect to a case where the dot forming methods are different, the optimum value for the provisional curing was determined. However, in the second embodiment, the same evaluation was further performed with the kind of medium changed.

As the medium, three kinds of mediums, film, synthetic paper, and paper-based medium were used. Then, the respective items (bleeding, cohesion, filling, and gloss) of the image quality in a case where the above-mentioned test pattern was printed on each medium were evaluated. On the other hand, since the evaluation method of the provisional curing (UV irradiation condition) and the evaluation items of image quality are the same as those in the first embodiment, explanation is omitted.

FIG. 14 is a view showing the experimental results for every kind of medium. Further, in FIG. 14, the test pattern is printed by the above-mentioned 4-pass dot forming method. From FIG. 14, conditions where print results were excellent in all the items of image quality were chosen. In the film, the condition of 0.3 A was chosen; in the synthetic paper, 0.4 A; and in the paper-based medium, 0.5 A. In this manner, the optimum value of the input current of the LED varies according to the medium.

Further, FIG. 15 is a view showing the relationship between the input current of the LED and the UV irradiation energy. For example, in the case of the film, the optimum input current value is 0.3 A, as described above, and at this time, the UV irradiation energy is 0.6 ($mW/cm^2$). Also, in the case of the synthetic paper, the optimum input current value is 0.4 A, and at this time, the UV irradiation energy is 0.8 ($mW/cm^2$). Also, in the case of the paper-based medium, the optimum input current value is 0.5 A, and at this time, the UV irradiation energy is 1.0 ($mW/cm^2$). In this manner, the optimum UV irradiation energy for curing UV ink varies according to the kind of medium. This is considered to be due to the fact that the ease (wetness) of spread at the time when UV ink landed varies according to the kind of medium. With respect to the 2-pass dot forming method, the same evaluation was performed.

FIG. 16 is a view showing the experimental results of the second embodiment. From the drawing, the optimum input current varies for every medium. That is, the optimum UV irradiation energy varies for every medium. Also, with respect to each medium, the optimum input current becomes larger in the case of the 2-pass dot forming method than the case of the 4-pass dot forming method. This is considered to be due to the same reason as the above-described first embodiment.

On the basis of the above-mentioned experimental results, in the printer 1 of the second embodiment, the controller 60 changes the input current to the LED of the irradiation sections 42*a* and 42*b* for provisional curing in accordance with the combination of the kind of medium and the dot forming method. For example, in the case of performing printing on the film system medium by the 4-pass dot forming method, the input current of the LED is set to be 0.3 A. Also, in the case of performing printing on the paper-based medium by the 2-pass dot forming method, the input current of the LED is set to be 1.0 A. That is, the UV irradiation energy is changed in accordance with the combination of the dot forming method and the kind of medium. Accordingly, a difference in the image quality of the printed image can be further reduced.

Other Embodiments

Although the printer as one embodiment has been explained, the above-described embodiments are for easy understanding of the invention, not for construing the invention as being limited to it. The invention can be modified or improved without departing from the purpose thereof, and also it is needless to say that the equivalent thereto is included in the invention. In particular, embodiments described below are also included in the invention.

In the above-described embodiments, with respect to gloss, a decision that gloss has no problem is rated as ○. However, besides this, the printed matter of mat tone may also be obtained by choosing the condition of lower gloss, or the printed matter of gloss tone may also be obtained by choosing the condition of higher gloss. Also with respect to other evaluation item such as a filling state, such a provisional curing condition as to provide a given print quality as desired may also be chosen. Also in these cases, since such provisional curing condition as to provide a given print quality as desired varies according to the dot forming methods or the mediums, it may also be changed.

Also, in the above-described embodiments, printing is performed by using ink of four colors, Y, M, C, and K. However, besides this, other liquid may also be used. For example, in the case of performing printing by using electromagnetic ray curing type liquid, which is clear ink having gloss property without including a color material, in combination with colored ink or separately, the provisional curing condition of the clear ink may also be changed according to the dot forming methods of the clear ink or the mediums.

In the above-described embodiment of FIG. 7, the dots of alternate pixels of a certain raster line are alternately printed in two passes, and the raster line adjacent to the above-mentioned raster line is printed in other passes.

However, besides this mode, among the pixels of a certain raster line, there may also be pixels at which the dots are adjacently formed in the same pass, and not in alternating passes. In particular, the dots of pixels may also be randomly printed by multiple passes. Also, there may also be three or more passes. In this case, the probability that in the same pass, adjacent pixels will be printed with respect to the pixels which are printed in a certain pass varies according to the number of passes which print the raster line. That is, the higher the number of passes is, the lower the probability is, and the lower the number of passes is, the higher the probability is. Therefore, it is preferable if a provisional curing condition is changed according to the number of one or more passes which print the raster lines.

Also, in the above-described embodiments, in FIGS. 6 and 7, the raster line between the raster lines which are determined according to a nozzle pitch of the nozzle row and can be printed in the same pass is printed by other pass. However, besides this mode, a configuration may also be made such that other raster line which is printed in other pass is not provided in the nozzle pitch of the nozzle row. In this case, for example, in FIG. 6, if the nozzle row is prepared in two rows, the nozzles of two nozzle rows are disposed to be staggered in the transport direction by half of the nozzle pitch, and then printing is performed by using both of the two nozzle rows, it becomes possible to print adjacent raster lines in the same pass. Or, in FIG. 6, a configuration may also be made such that after only the odd-number raster lines of the drawing are set to be printed and a dot size is set to be large, then by printing only the odd-number raster lines, the medium is filled with dots. Also in these cases, similarly to the above-mentioned case, a certain raster line may also be printed by a plurality of two or more passes, and in this case, the probability that in the same pass, pixels which are adjacent in the raster line direction or the transport direction will be printed with respect to the pixels which are printed in a certain pass varies according to the number of passes. Therefore, also in this case, it is preferable that a provisional curing condition be changed according to the number of one or more passes which print the raster lines.

That is, summarizing the above-mentioned Contents, it is preferable if a provisional curing condition is changed in each of the dot forming methods which are different in probability that in the same pass, the dots of the pixels which are adjacent in the moving direction (raster line direction) or the transport direction will be printed with respect to the dots of the pixels which are formed in a certain pass.

Concerning Printer

Although in the above-described embodiments, a printer is described as one example of a dot omission inspection apparatus, the invention is not to be limited to this. For example, the same technology as this embodiment may also be applied to various liquid discharging apparatuses to which ink jet technology is applied, such as a color filter manufacturing apparatus, a dyeing apparatus, a micro-fabrication apparatus, a semiconductor manufacturing apparatus, a surface processing apparatus, a three-dimensional modeling device, a liquid vaporization apparatus, an organic EL manufacturing apparatus (in particular, a high molecular EL manufacturing apparatus), a display manufacturing apparatus, a film formation apparatus, and a DNA chip manufacturing apparatus.

Concerning Nozzle

In the above-described embodiments, ink is discharged by using a piezoelectric element (piezo element). However, a liquid discharging method is not to be limited to this. For example, other method may also be used such as a method which generates bubbles in nozzles by using heat.

Concerning Ink

In the above-described embodiments, ink (UV ink) which is cured by being subjected to the ultraviolet rays (UV) irradiation is discharged from the nozzles. However, liquid which is discharged from the nozzles is not to be limited to the UV ink, but liquid which is cured by being subjected to the irradiation of electromagnetic waves (for example, visible light or the like) other than UV may also be discharged from the nozzles. In this case, it is preferable that the electromagnetic waves (visible light or the like) for curing the liquid be emitted from the irradiation sections 42*a* and 42*b* for provisional curing and the irradiation section 43 for main curing.

Concerning Irradiation Section for Provisional Curing

In the above-described embodiments, the irradiation sections for provisional curing were respectively provided at both ends in the moving direction of the carriage 21. However, it may also be provided only on the side which becomes the rear of the position in the moving direction of the head 31 during the forming of the dots. For example, in this embodiment, only the irradiation section 42*a* for provisional curing may also be provided. In this case, UV may also be irradiated only during the forward movement, or in both periods of the forward movement and the backward movement.

The entire disclosure of Japanese Patent Application No. 2008-330977, filed Dec. 25, 2008 is expressly incorporated by reference herein.

What is claimed is:

1. A liquid discharging apparatus comprising:

nozzles which discharge liquid which is cured by the irradiation of electromagnetic waves;

an irradiation section which irradiates the electromagnetic waves to dots formed on a medium by the liquid discharged from the nozzles, wherein the irradiation section includes a preliminary irradiation section which irradiates the electromagnetic waves of a first irradiation amount which suppresses the spread of dots, and a main irradiation section which irradiates the electromagnetic waves of a second irradiation amount larger than the first irradiation amount after the irradiation by the preliminary irradiation section; and a controller which controls the discharging of the liquid from the nozzles and changes the first irradiation amount of the electromagnetic waves that the irradiation section irradiates, according to methods of forming the dots.

2. The liquid discharging apparatus according to claim 1, wherein the dots are formed on the medium by alternately repeating a liquid discharging operation which discharges liquid from a nozzle row, in which a plurality of nozzles are arranged in a given direction, while relatively moving the nozzle row with respect to the medium in a direction crossing the given direction, and a transportation operation which transports the medium in the given direction, and the preliminary irradiation section moves in a direction crossing the given direction along with the nozzle row during the liquid discharging operation, so as to irradiate the electromagnetic waves to the dots formed on the medium.

3. The liquid discharging apparatus according to claim 2, wherein the method of forming the dots is based on whether or not the dots are formed at adjacent pixels on the medium by the same liquid discharging operation.

4. The liquid discharging apparatus according to claim 1, wherein the controller further changes the irradiation amount of the electromagnetic waves which the irradiation section irradiates, according to the kind of medium.

5. The liquid discharging apparatus according to claim 1, wherein in a first dot forming method and a second dot forming method, the same driving signal is used in order to discharge liquid from the nozzles.

6. The liquid discharging apparatus according to claim 1, wherein the electromagnetic waves are ultraviolet rays, and the liquid is ultraviolet cure type ink which is cured by being subjected to the irradiation of the ultraviolet rays.

7. An image forming method of a liquid discharging apparatus, which forms an image on a medium by discharging liquid from nozzles, the method comprising:

discharging liquid which is cured by the irradiation of electromagnetic waves, from the nozzles; and irradiating the electromagnetic waves to dots formed on the medium by the liquid discharged from the nozzles, wherein the irradiation section includes a preliminary irradiating which irradiates the electromagnetic waves of a first irradiation amount which suppresses the spread of dots, and a main irradiating which irradiates the electromagnetic waves of a second irradiation amount larger than the first irradiation amount after the irradiation by the preliminary irradiating, and wherein the first irradiation amount of the electromagnetic waves is changed according to methods of forming the dots.

* * * * *